US005750069A

United States Patent [19]

Lew et al.

[11] Patent Number: 5,750,069

[45] Date of Patent: May 12, 1998

[54] METHOD AND APPARATUS FOR DISCRIMINATING VEHICLE TYPES

[75] Inventors: Yung-bai Lew; Won-seo Park, both of Sungnam; Yong-sung Park; Young-ho Kim, both of Kyungki-do; Sang-il Park, Seoul; In-soo Kim; Chang-sup Woo, both of Suwon, all of Rep. of Korea

[73] Assignee: SamSung Electronics Co., Ltd., Kyungki-do, Rep. of Korea

[21] Appl. No.: 777,068

[22] Filed: Dec. 30, 1996

[30] Foreign Application Priority Data

Dec. 30, 1995 [KR] Rep. of Korea ..... 95-69691

[51] Int. Cl.[6] ..... G08G 1/01

[52] U.S. Cl. ..... 340/933; 340/937; 340/942; 701/117

[58] Field of Search ..... 340/909, 928, 340/931, 933, 937, 940, 942; 364/553, 554; 701/117; 246/247; 200/86 A; 235/381, 384; 177/210 R

[56] References Cited

U.S. PATENT DOCUMENTS

| | | | |
|---|---|---|---|
| 3,686,627 | 8/1972 | Rubenstein | 340/928 |
| 3,705,976 | 12/1972 | Platzman | 340/928 |
| 3,721,820 | 3/1973 | Caulier | 246/247 |
| 3,748,443 | 7/1973 | Kroll | 340/940 |
| 3,794,966 | 2/1974 | Platzman | 340/928 |
| 3,828,307 | 8/1974 | Hungerford | 340/909 |
| 3,855,449 | 12/1974 | Viracola | 392/322 |
| 3,872,283 | 3/1975 | Smith | 340/933 |
| 3,927,389 | 12/1975 | Neeloff | 340/940 |
| 4,163,283 | 7/1979 | Darby | 377/20 |
| 4,248,396 | 2/1981 | Hunt | 246/247 |
| 4,260,877 | 4/1981 | Conway | 33/123 |
| 4,303,904 | 12/1981 | Chasek | 340/928 |
| 4,483,076 | 11/1984 | Brooks | 200/86 A |
| 4,582,279 | 4/1986 | Pontier | 340/933 |
| 4,757,243 | 7/1988 | Gaucher | 340/940 |
| 4,763,267 | 8/1988 | Knight et al. | 364/436 |
| 4,787,581 | 11/1988 | Dobler et al. | 340/933 |
| 4,788,645 | 11/1988 | Zavoli | 364/449 |
| 5,007,032 | 4/1991 | Jensen | 367/136 |
| 5,008,666 | 4/1991 | Gebert | 340/936 |
| 5,260,520 | 11/1993 | Muhs et al. | 177/210 R |
| 5,297,484 | 3/1994 | Piserchia et al. | 246/187 A |
| 5,337,257 | 8/1994 | White | 364/554 |
| 5,373,128 | 12/1994 | Rosakranse | 200/86 A |
| 5,446,291 | 8/1995 | Becker | 340/942 |
| 5,617,086 | 4/1997 | Klashinsky et al. | 340/933 |
| 5,621,195 | 4/1997 | Taylor et al. | 246/247 |

*Primary Examiner*—Brent A. Swarthout
*Assistant Examiner*—Van Trieu
*Attorney, Agent, or Firm*—Robert E. Bushnell, Esq.

[57] ABSTRACT

A technique for discriminating a vehicle uses the pressures of tires of a vehicle passing on a pair of contact-point boards, which are converted into digital signals by using shift registers, and measures the width of the tires and the distance between tires, and counts the axles of the vehicle, according to the converted signals. The tire width of a vehicle, the distance between the left and right tires and the number of axles are processed in real time by outputting a digital signal from a contact-point in which a board portion makes contact with a tire of a passing vehicle. Furthermore, even if either one of the contact-point boards for discriminating a vehicle type breaks down, a vehicle can still be discriminated.

19 Claims, 10 Drawing Sheets

METHOD AND APPARATUS FOR DISCRIMINATING VEHICLE TYPES

CLAIM OF PRIORITY

This application makes claims all benefits accruing under 35 U.S.C. § 119 from an application for METHOD AND APPARATUS FOR DISCRIMINATING VEHICLE TYPES earlier filed in the Korean Industrial Property Office on 30 Dec. 1995 and there duly assigned Ser. No. 69691/1995.

BACKGROUND OF THE INVENTION

1. Field of the Invention

The present invention relates to a method and apparatus for discriminating vehicle types, and more particularly, to a method and apparatus for discriminating vehicle types in which the pressures exerted by the tires of a vehicle passing over contact-point boards are converted into digital signals by using shift registers, and in which the width of the tires and the distance between the left and right tires of an axle are measured and the number of axles of the vehicle are counted, according to the converted signals.

2 Description of the Related Art

Generally, the toll for toll roads and toll bridges vary depending on the class of a vehicle and the destination. In a typical toll road system, a passage ticket is issued in which the ticket is encoded with the name or code of the departure toll gate or interchange, and the date and time of passage through the departure toll gate or interchange, and a toll is collected at the destination toll gate based on the data on the ticket. To collect such tolls, however, the vehicle must stop for toll gate personnel to issue the ticket to the drivers, and due to an increase in the number of toll roads, more personnel are required. Therefore, a completely automated toll-collecting system for an interchange must be explored.

In earlier vehicle discriminating apparatus, a board portion including a predetermined resistance circuit is connected to a resistance-to-voltage converter for converting the resistance output from the board portion into a voltage. Also included are A storing portion for storing the voltage converted in the resistance-to-voltage converter, an analog-to-digital converter for converting the voltage stored in the storing portion into a digital signal, a counter portion for counting the number of axles of a vehicle based on the opening or closing state of the contact point boards of the board portion, determining the forward and backward movement of the passing vehicle in determining the class of the passing vehicle, an optical sensor for discriminating between vehicles from information on the sides of the passing vehicles, a controlling portion of receiving the signals output from the analog-to-digital converter, counter portion, and optical sensor, and a central processing portion for discriminating the vehicle while making calculations according to a program stored in a memory and processing output signals form the controlling portion.

In the board portion, a large number of resistors (e.g., 174 resistors) are connected in series at small (e.g., 1 cm) intervals.

The upper contact point boards of the board portion consist of two resistor portions for measuring the width of the tire and the distance between the left and right tires of a passing vehicle and four contact point boards for counting the number of axles of the vehicle, determining whether the vehicle is moving backward or forward, and determining what class the vehicle is.

When a vehicle passes over the contact point boards of the board portion, the resistance-to-voltage converter converts a resistance into a voltage according to the pressure of the tires of the vehicles. The low voltage converted into resistance-to-voltage converter is stored in the storing portion and then converted into a digital signal for sampling by the analog-to-digital converter. The controlling portion receives a signal output from the counter portion, the optical sensor, and the analog-to-digital converter and outputs the signals to the central processing unit. The central processing unit measures the tire width and the distance between the left and right tires of the vehicle by passing the signals to the program stored in the memory, thereby discriminating the vehicle type.

However, the earlier apparatus exhibits problems of operation failure due to malfunctions of either of the contact point boards. Also, the installation and repair of the apparatus is difficult due to the many signals required at the interface of the contact points and the controlling portion.

The patent to Becker et al., U.S. Pat. No. 5,446,291 entitled Method For Classifying Vehicles Passing A Predetermined Waypoint, discloses a method of classifying vehicles utilizing optical and magnetic sensors to determine the vehicle size and axle count.

The patent to Rosakranse et al., U.S. Pat. No. 5,373,128 entitled Wheel Sensing Treadle Matrix Switch Assembly For Roadways, discloses a wheel sensing treadle matrix of switches for vehicle classification. The tire width, the number of tires and axles, and spacing are calculated.

The Gaucher patent, U.S. Pat. No. 4,787,243, entitled Device For Detecting A Dimension, In Particular A Tread Width On A Path, calculates the tire width and distance using plural contacts and pressure transducers.

The Brooks patent, U.S. Pat. No. 4,483,076 entitled Ground Contact Area Measurement Device, measure the area and shape of a contact between a vehicle's widths or tracks via a contact matrix for vehicle size and area calculations.

The Viracola patent, U.S. Pat. No. 3,835,449 entitled Method And Apparatus For Classifying The Tire Width Of Moving Vehicles, discloses a system for calculating axle and tire classification utilizing axle counting and a sensor matrix.

The Caulier et al. patent, U.S. Pat. No. 3,721,820 entitled Computing Car Locations In A Train, discloses a computer system for measuring the successive distances between the wheels of a car in a train and processing the measurements to locate a given axle of a car such as a first axle of a track of a car or the first axle of the car.

The following additional patents disclose features in common with the present invention, but are not deemed to be as pertinent as the patents discussed above: U.S. Pat. No. 5,337,257 to While, entitled Moving vehicle Classifier With Nonlinear Mapper, U.S. Pat. No. 5,008,666 to Gebert et al., entitled Traffic Measurement Equipment, U. S. Patent No. 4,788,645 to Zavoli el al., entitled Method And Apparatus For Measuring Relative Heading Changes In A Vehicular Onboard Navigation System, U.S. Pat. No. 4,582,279 to Pontier, entitled Modulation System For Railway Track Circuits, U.S. Pat. No. 4,303,904 to Chasek, entitled Universally Applicable, In-Motion And Automatic Toll Paying System Using Microwaves, U.S. Pat. No. 4,260,877 to Conway, entitled Area Measuring Apparatus For Attachment To A Linear Convertor, U.S. Pat. No. 4,248,396 to Hunt Jr., entitled Method And Apparatus For Detecting Railroad Cars, U. S. Pat. No. 4,163,283 to Darby, entitled Automatic Method To Identify Aircraft Types, U.S. Pat. No. 3,927,389 to Neeloff, entitled Device For Determining During Operation, The Category Of A Vehicle According To A Pre-Established Group Of Categories, U.S. Pat. No. 3,872,283 to Smith et al., entitled Vehicle Identification Method And Apparatus, U.S. Pat. No. 3,794,966 to Platzman, entitled Automatic Vehicle Classification And Ticket Issuing System, U.S. Pat. No. 3,748,443 to Kroll et al., entitled Wheel Sensing Apparatus, U.S. Pat. No. 3,705,976 to Platzman, entitled Revenue Control System For Toll Roads, and U.S. Pat. No. 3,686,627 to Rubenstein, entitled Toll Booth System.

SUMMARY OF THE INVENTION

To overcome the above problems, the object of the present invention is to provide a method and apparatus for discriminating vehicle types, in which the pressures of the tires of a vehicle passing on contact-point boards are converted into digital signals by using shift registers, and in which the widths of the tires and the distance between the left and right tires of an axle are measured and the number of axles of the vehicle are counted, according to the converted signals.

To achieve one aspect of the above object, there is provided a vehicle-type discriminating apparatus comprising: a board portion for outputting a serial digital signal from a contact-point board in which said board portion makes contact with a tire of a passing vehicle; a serial-to-parallel converting portion for converting said serial digital signal output from said board portion into a parallel digital signal; a parallel port interface; a clearing portion for resetting an uncertain signal output from said board portion; a digital-to-analog converting portion for converting said digital signal into an analog signal for counting the number of axles of said passing vehicle; an interrupt portion for determining whether contact-point boards are pressed, and setting a parallel-input-serial-output (P/S) signal at a high level, to wait to receive an input signal; an optical sensing portion for projecting an optical signal to discriminate between continuously passing vehicles; a controlling portion for controlling the signals output from said parallel port interface, said clearing portion, said digital-analog portion, said interrupt portion, and said optical sensing portion and for storing the signals in a first memory; a second memory for storing a predetermined vehicle-type discriminating program; and a central processing portion for discriminating said vehicle by calculating the tire width, the distance between the left and right tires, and the number of the axles of said vehicle, on the basis of said predetermined vehicle-type discriminating program stored in said second memory, according to a signal output from said controlling portion.

To achieve another aspect of the above object, there is provided a vehicle-type discriminating method comprising the steps of: (a) counting the number of axles of a vehicle; (b) discriminating the vehicle into the fourth class, if said number of axles is 3 in said step (a), and discriminating the vehicle into the fifth class, if said number of axles is greater than 3; (c) determining whether the tire width of said vehicle is 28 cm or over, if said number of axles is 2; (d) determining whether the maximum tire width is 15 cm or less, if the tire width is less than 28 cm in said step (c); (e) discriminating said vehicle into the first class, if the tire width is over 15 cm in said step (d); (f) determining whether the distance between the left and right tires is less than 120 cm, if the tires width is 15 cm or less in said step (d); (g) discriminating said vehicle as a compact vehicle, if the distance between the left and right tires is less than 120 cm in said step (f), and discriminating said vehicle into the first class, if the distance between the left and right tires is 120 cm or over; (h) determining whether the tire width is 37 cm or over, if the tire width is 28 cm or over in said step (c); (i) determining whether the distance between the left and right tires is 136 cm or over, if the maximum tire width is less than 37 cm in said step (h); (j) discriminating said vehicle into the first class, if the distance between the left and right tires is 136 cm or over in said step (i); (k) determining whether the distance between the left and right tires is 180 cm, if the tire width is 37 cm or over in said step (h), and the distance between the left and right tires is 136 cm or over; (i) discriminating said vehicle into the third class if the distance between the left and right tires is 180 cm or over, and discriminating said vehicle into the second class if the distance between the left and right tires is less than 180 cm; and (m) determining that said vehicle is not a real vehicle, if the number of said axles is 1 in said step (a).

To achieve yet another aspect of the above object, there is provided a method for discriminating a single tire from a double tire of a passing vehicle comprising the steps of: (a") determining whether a tire is of a first axle of the vehicle; (b") discriminating said tire as a single tire if said tire is of the first axle in said step (a"); (c") determining whether the width of said tire is 19 cm or over; (d") discriminating said tire as a single tire if the width of said tire is less than 19 cm in said step (c"); (e") subtracting the width of said first-axle tire from the width of a passing-axle tire if the width of said tire is 19 cm or over in said step (c"); (f") determining whether the subtrahend of said step (e") is 7 cm or over; and (g") discriminating said tire as a single tire if the subtrahend is less than 7 cm in said step (f"), and discriminating said tire as a double tire if the result is 7 cm or over.

According to the vehicle-discriminating apparatus of the present invention, said board portion comprises shift registers for outputting a digital signal corresponding to a contact-point board in which a tire of said passing vehicle makes contact with said board portion.

According to the vehicle-discriminating method of the present invention, to discriminate a real 3-axle vehicle from a vehicle appended with an ordinary first-class vehicle which may be misjudged as a 3-axle vehicle, the step (a) comprises the steps of: (a') determining whether the tire width of a passing vehicle is equal to or greater than 28 cm; (b') discriminating the vehicle type into the first class, if it is determined in step (a') that the tire width is less than 28 cm; (c') determining whether the distance between left and right tires is equal to or greater than 136 cm; and (d') discriminating the vehicle type into the first class, if the tire width is equal to or greater 28 cm and if the distance between the left and right tires is less than 136 cm in the step (c'), otherwise discriminating the vehicle as a 4-axle vehicle.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
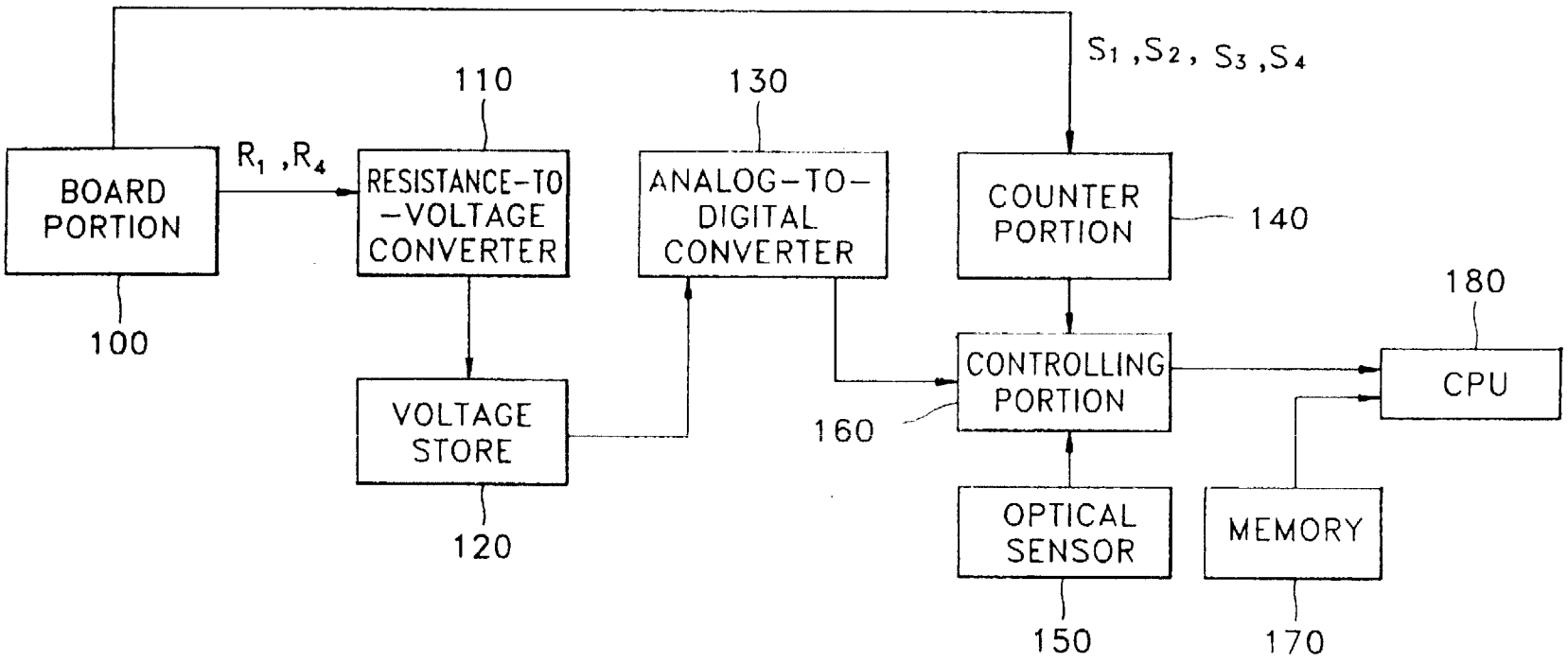
FIG. 1 is a schematic block diagram of an earlier vehicle-type discriminating apparatus.

FIG. 1 is a block diagram schematically illustrating an earlier apparatus for discriminating vehicle types. The vehicle-type discriminating apparatus is comprised of a board portion 100 including a predetermined resistance circuit, a resistance-to-voltage converter 110 for converting the resistance output from the board portion 100 into a voltage, a storing portion 120 for storing the voltage converted in the resistance-to-voltage converter 1 10, an analog-to-digital converter 130 for converting the voltage stored in the storing portion 120 into a digital signal, a counter portion 140 for counting the number of axles of a vehicle based on the opening or closing state of the contact point boards of the board portion 100, determining the forward and backward movement of the passing vehicle and determining the class of the passing vehicle, an optical sensor 150 for discriminating between vehicles from information on the sides of the passing vehicles, a controlling portion 160 for receiving the signals output from the analog-to-digital converter 130, counter portion 140 and optical sensor 150, and a central processing portion (CPU) 180 for discriminating the vehicle by making calculations according to a program stored in a memory 170 and processing signals output from the controlling portion 160.

Figure 2:
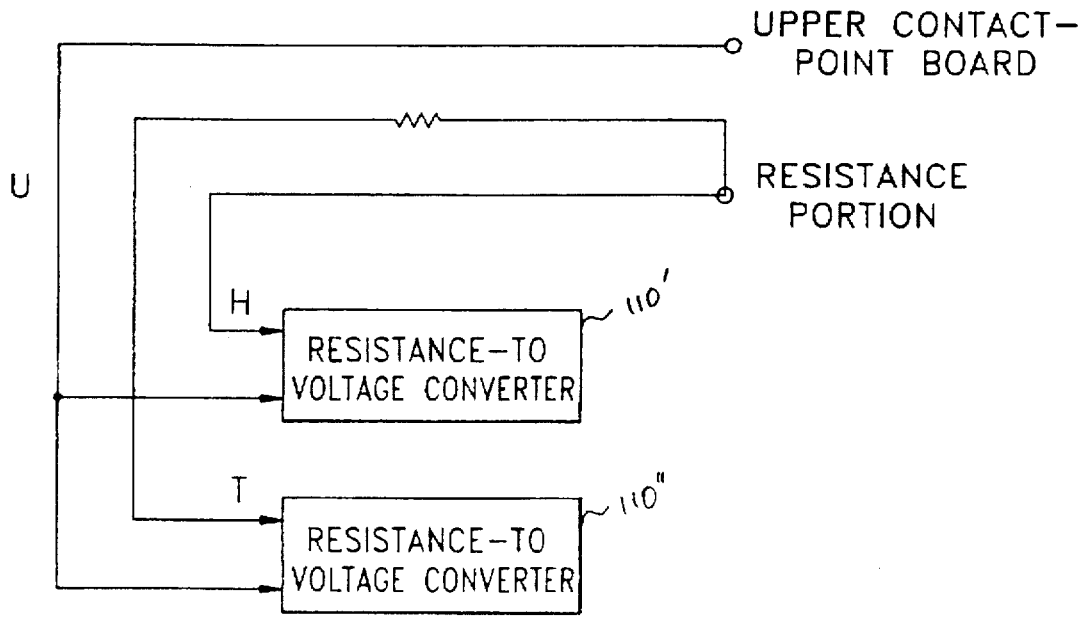
FIG. 2 illustrates component circuits of the board portion shown in FIG. 1.

FIG. 2 illustrates a component circuit of the board portion 100 of FIG. 1. In the board portion 100, 174 16Ω-resistors are connected in series at 1-cm intervals. The upper contact-point board is constituted by a closed circuit between U and H, and a closed circuit between U and T via resistance to voltage converters 110' and 110" by the pressures of the tires of a passing vehicle.

Figure 3:
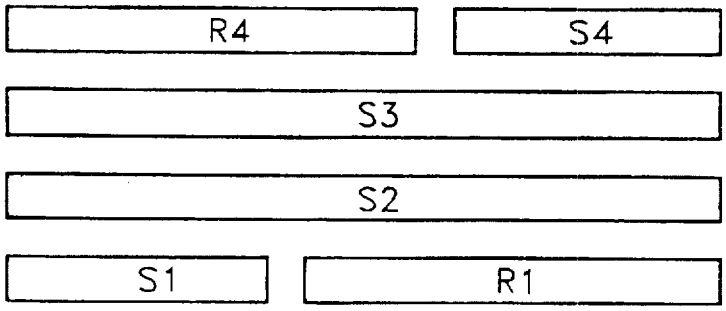
FIG. 3 illustrates the arrangement of upper contact-point boards of the board portion shown in FIG. 1.

FIG. 3 illustrates the upper contact-point boards of the board portion 100. Reference numerals R1 and R4 are 1.7 m-long contact-point boards for measuring the width of a tire and the distance between the left and right tires of a passing vehicle. Reference numerals S1, S2, S3 and S4 are contact-point boards for counting the number of axles of the vehicle, determining whether the vehicle is moving forward or backward, and determining what class the vehicle is.

Referring to FIGS. 1–3, the operation of the earlier vehicle-discriminating apparatus will be described.

When a vehicle passes over the contact-point boards of board portion 100, the resistance-to-voltage converter 110 converts a resistance into a voltage according to the pressure of the tires of the vehicle. The load voltage converted in the resistance-to-voltage converter 110 is stored in the storing portion 120. The load voltage stored in the storing portion 120 is converted into a digital signal through sampling in the analog-to-digital converter 130. The controlling portion 160 receives the signals output from the counter portion 140, the optical sensor 150, and the analog-to-digital converter 130, and outputs the signals to the CPU 180. The CPU 180 measures the tire width and the distance between the left and right tires of the vehicle by passing the signals through a program stored in the memory 170, thereby discriminating the vehicle type.

However, the earlier vehicle-type discriminating apparatus exhibits problems of operation failure due to malfunction at either of the contact-point boards R1 and R4. Also, the installation and repair of the apparatus is not easy due to the many signals required at the interface of the contact-points and the controlling portion.

Figure 4:
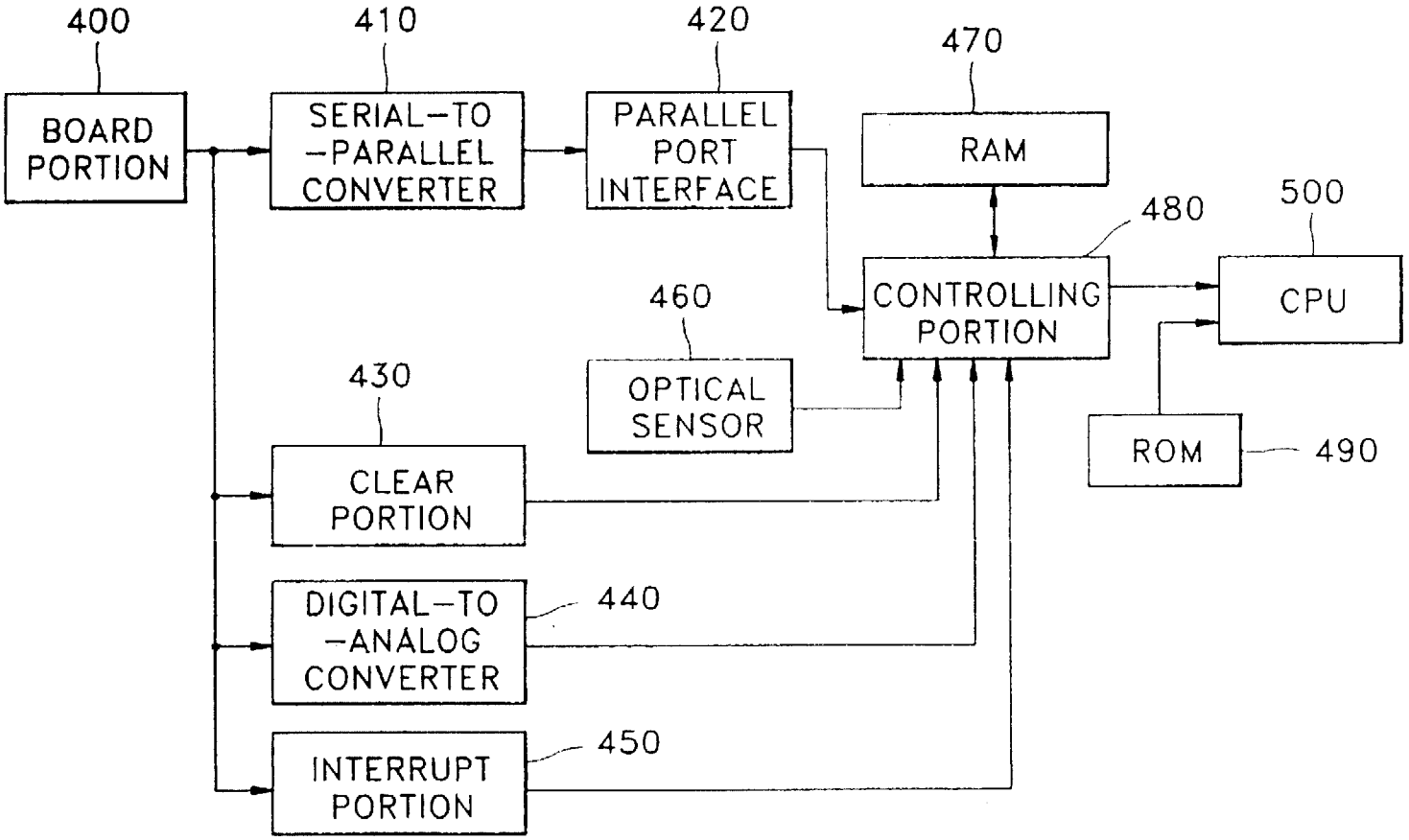
FIG. 4 is a schematic block diagram of a vehicle-type discriminating apparatus according to the present invention.

FIG. 4 is a block diagram of a vehicle-type discriminating apparatus according to the present invention.

The vehicle-discriminating apparatus is comprised of a board portion 400 having 35 shift registers, for outputting digital signals SD-1, SD-4, S2 and S3 corresponding to contact-point boards with which the tires of a passing vehicle are brought into contact, a serial-to-parallel converter 410 for converting a serial digital signal output from the board portion 400 into a parallel digital signal, a parallel port interface (PPI) 420, a clearing portion 430 for resetting an uncertain signal output from the board portion 400, a digital-to-analog converter 440 for converting digital signals output from board portion 400 into analog signals S1 and S4 for counting the number of axles of the passing vehicle, an interrupt portion 450 for determining whether or not contact-points of the board portion 400 are pressed, and setting a parallel-input-serial-output (P/S) signal at high, thereby receiving input signals of the vehicle, an optical sensor 460 for discriminating between vehicles, a controlling portion 480 for receiving the signals output from the PPI 420, the clearing portion 430, the digital-to-analog converter 440, the interrupt portion 450 and the optical sensor 460, and a CPU 500 for calculating the tire width, the distance between the left and right tires, and the number of axles of a passing vehicle by a vehicle-discriminating program stored in a ROM 490, according to the signals output from controlling portion 480, thereby discriminating the vehicle type.

Figure 5:
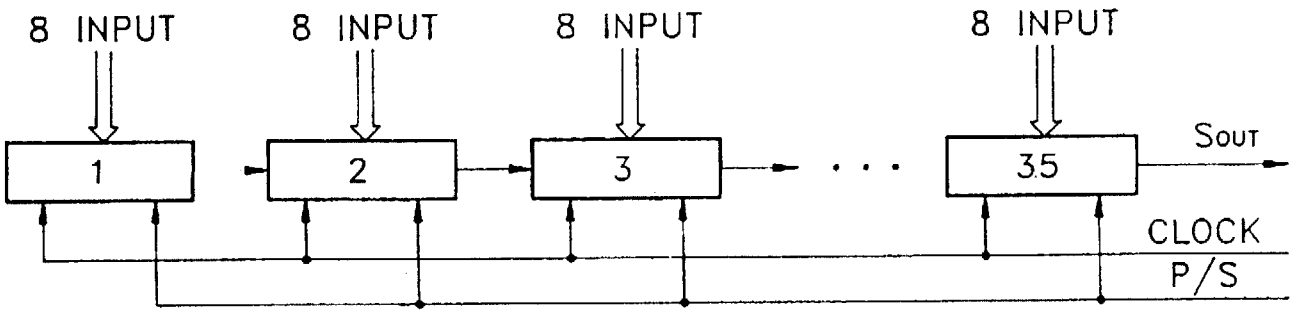
FIG. 5 is a more detailed illustration of the board portion shown in FIG. 4.

FIG. 5 illustrates the board portion 400 shown in FIG. 4 in more detail. In the board portion 400, 35 shift registers are connected in series, each register having 8 inputs and connected to a clock line and a P/S signal line. The 35th shift register is connected to an output port. Here, the 8 input signals input to each shift register has 8 digital pulse signals. Provided the width of a pulse is 1 cm, the total width $S_{OUT}$ of the output pulses is 280 cm long. Thus, 280-bit data can be output.

Further, if a P/S signal is high when a vehicle passes over the board portion 400, 35-byte data, that is, 280-bit data is received in the 1st through 35th registers. If the P/S signal is low, the data of each register is serially shifted to the register to the right in units of one byte. For example, when the high P/S signal is changed into a low P/S signal while the vehicle passes over the board portion 400, 1-byte data of a register is shifted to the register to the right. Therefore, to output all 280 bits as $S_{OUT}$, the high signal must be changed into a low signal 35 times within a predetermined time.

Figure 6:
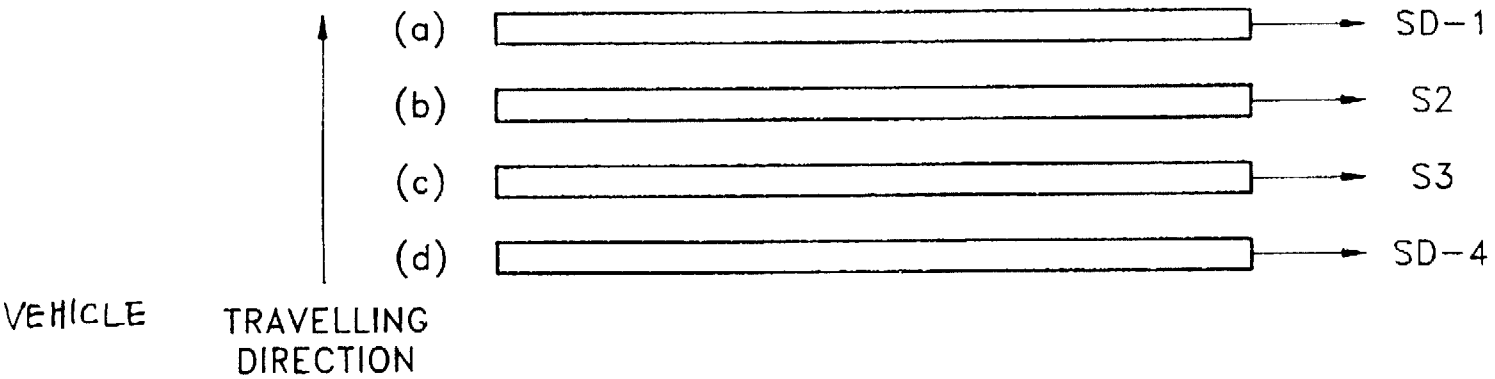
FIG. 6 illustrates the upper contact-point boards of the board portion according to the present invention.

FIG. 6 illustrates the contact-point boards of the board portion 400 according to the present invention. Contact-point boards (a) and (d) are constituted by registers as shown in FIG. 5. When a vehicle passes over the boards (a) and (d), signals SD-1 and SD-4 generated from the points in contact with a tire are output through the serial-to-parallel converter 410 under the control of the controlling portion 480. Then, the CPU 500 measures the tire width and the distance between the left and right tires of the passing vehicle by calculating the interval of pulses from the boards pressed by the tires, according to the signals output from the controlling portion 480, thereby discriminating the vehicle type.

In addition, the number of axles of the vehicle is counted, and a determination is made as to whether the vehicle in traveling forward or backward, and whether the vehicle is of the fourth or fifth class, by signals S2 and S3 output from contact-point boards (b) and (c), and signals S1 and S4 output from the digital-to-analog converter 440.

Figure 7:
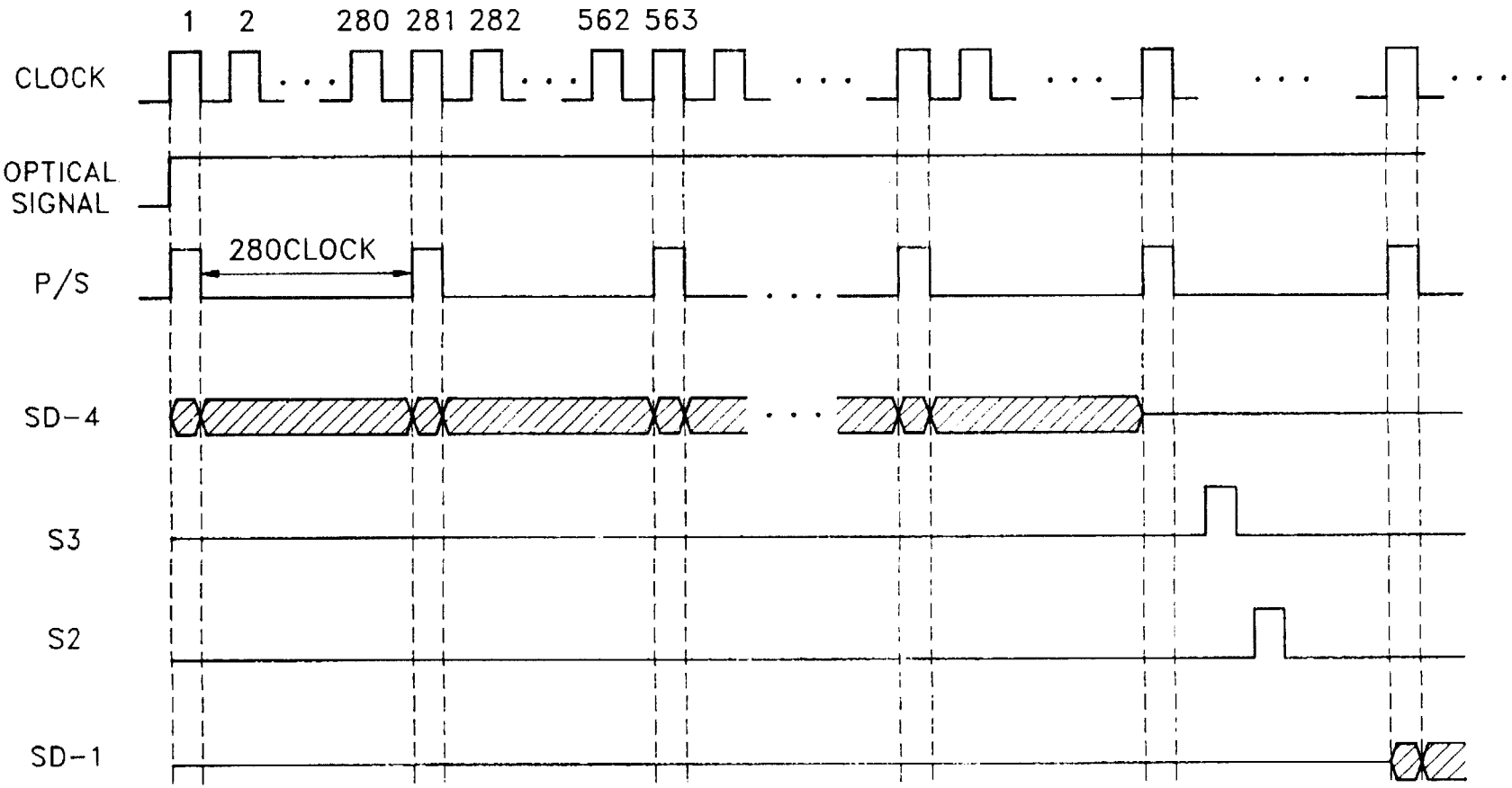
FIG. 7 illustrates the signals generated in the vehicle-type discriminating apparatus shown in FIG. 6, when a vehicle normally passes on the contact-points of the board portion.

FIG. 7 illustrates the waveforms of signals generated in the vehicle-type discriminating apparatus of FIG. 6 as a vehicle passes normally over the contact-point boards of the board portion 400. When the front-axle tires sequentially pass over the contact-point boards (d), (c), (b) and (a), with a normal clock signal input and an optical signal projected from the optical sensor 460, the waves of signals SD-4, S3, S2 and SD-1 are sequentially generated. When a rear axle passes, signals are generated in the same manner. That is, a P/S signal is a control signal for latching data output from the board and outputting the data when a vehicle passes over the board. If a first clock signal become high, the data is latched and then the latched data is output during generating 280 clock signals.

The tire width and the distance between the left and right tires are determined by the pulse widths of signals SD-1 and SD-4. The number of axles of the vehicle are counted, the direction of movement thereof is determined, and a determination between a fourth-class vehicle and a fifth-vehicle is made by combining signals S3 and S2 with signals S1 and S4 output from the digital-to-analog converter 440.

Referring to FIGS. 4–7, the operation of the vehicle-type discriminating apparatus according to the present invention will be described.

When a vehicle enters the contact-point boards of the board portion 400 shown in FIG. 6 at 60 km/h and the contact-point board (c) responds 16 ms later than the contact-point board (d), data of the contact-point board (d) is processed within 16 ms.

Then, it takes 48 ms for the tires of the rear axle of the vehicle to pass over the contact points (d), (c), (b) and (a) after the tires of the front axle thereof sequentially pass over the contact-point boards (d), (c), (b) and (a). Thus, all data is processed within 48 ms after the tires of the first axle passes the contact point boards (d), (c), (b) and (a).

Furthermore, assuming the frequency of the P/S signal is 40 kHz, its period T is 0.875 ms (T=1/(40 kHz)×35) and a clock cycle T is 0.0175 ms (T=1/(20 MHZ)×35).

Since this requirement is met even at a speed of 60 km/h or below, data is processed in a normal manner. Therefore, the 280-bit data (8 bits×35 shift registers) output from all the shift registers is output within 0.875 ms.

Serial signals SD-1 and SD-4 are converted into 8-bit parallel signals in the serial-to-parallel converter 410 of FIG. 4. Then, if the 8-bit parallel signals are input to the controlling portion 480 through the PPI 420, the controlling portion 480 stores the vehicle-type discriminating data of signal SD-4 in the RAM 470.

Thereafter, the data of signal SD-1 is compared with the data of signal SD-4 stored in the RAM 470 in order to calculate the tire width, and the distance between the left and right tires, with more accuracy. Needless to say, the tire width and the distance between the left and right tires can be calculated with either of signals SD-1 and SD-4.

The width of the tires and the distance between the left and right tires of the rear axle are calculated in the same manner.

Further, the data of signals S3 and S2 of the front axle are stored in the RAM 470, and is compared with the data of S3 and S2 of the rear axle, to thereby count the number of axles.

Therefore, in the present invention, even if one of the contact-point boards (d) and (a) were to fail completely, the vehicle type could still be discriminated with the other normal contact-point board.

In the digital-to-analog converter 440, digital signals output from the board portion 400 are converted into analog signals S1 and S4. These signals S1 and S4 are combined with S2 and S3, to thereby count the number of axles, determine the forward or backward movement of the vehicle, and discriminate the vehicle into a fourth class or a fifth class.

The interrupt portion 450 determines whether the contact-point boards have peen pressed, and activates the P/S signal, thus the interrupt portion 450 waits to receive the 35-byte data.

In the clearing portion 430, an uncertain signal is reset from a signal input after the vehicle passes through the board portion 400.

Figure 8:
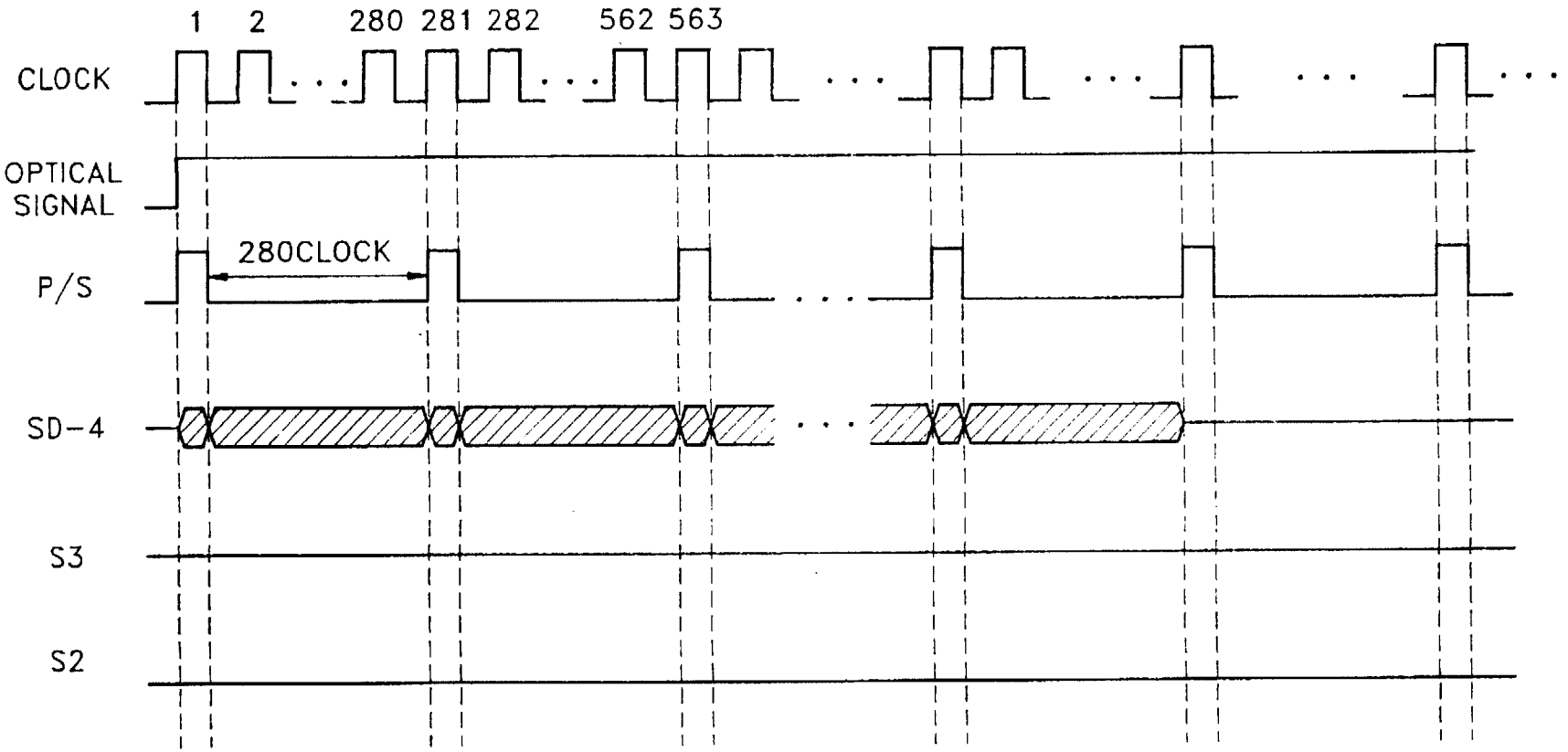
FIG. 8 illustrates the signals generated when a vehicle stops on the board portion.

FIG. 8 illustrates the waveforms of signals when the vehicle stops on board portion 400.

When data is continuously read in units of 280-bit unit, if signals S2 and S3 are not detected, it is determined that a tire of the vehicle is continuously pressing on the contact-point board (d), and the tire width and the distance between tires are measured only with the initial 280-bit data.

Figure 9:
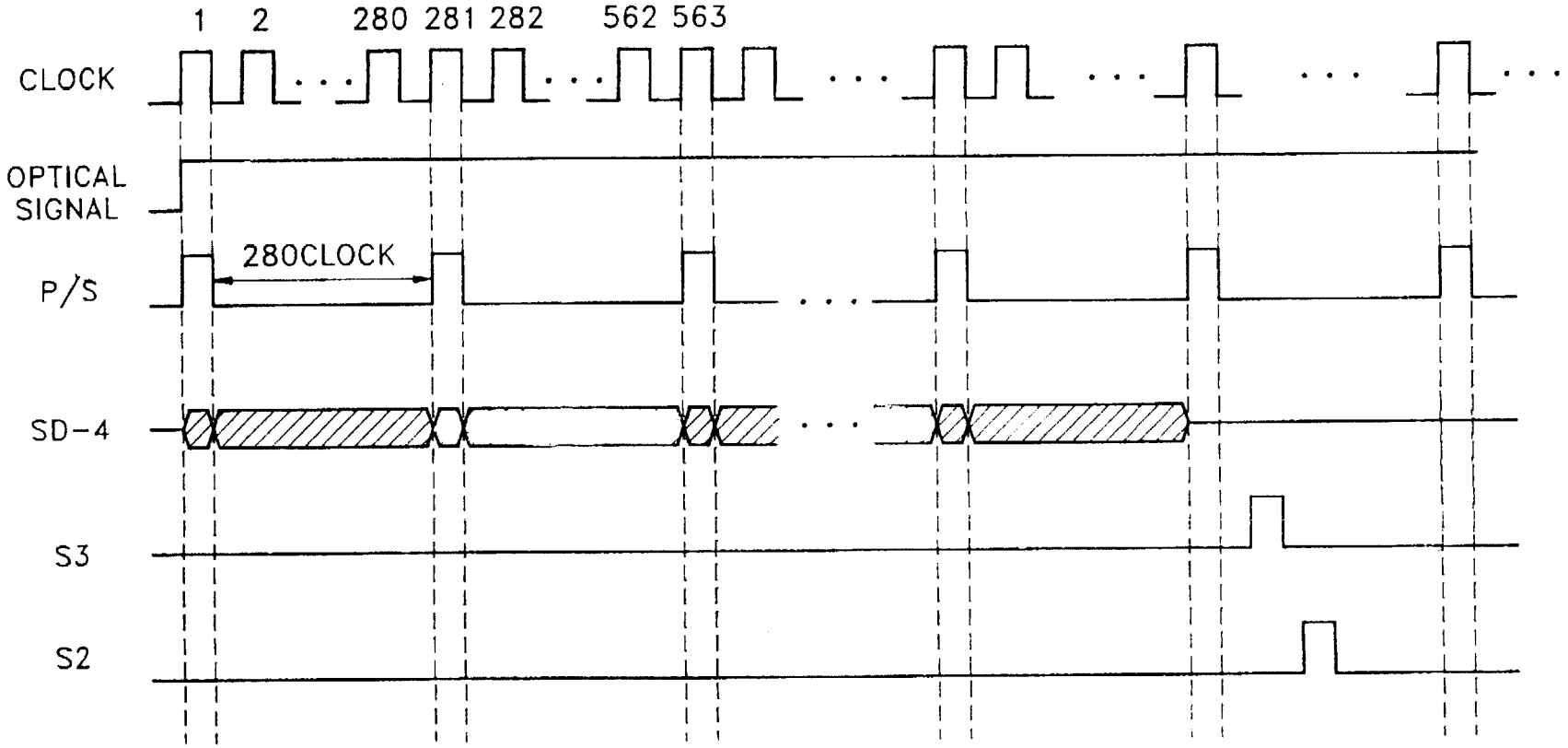
FIG. 9 illustrates the signals generated when an object other than a vehicle applies pressure to the board portion.

FIG. 9 illustrates the waveforms of signals when an object other than a vehicle presses on the board portion 400. When the output data is not normal, it is determined that the object is not a vehicle.

Figure 10:
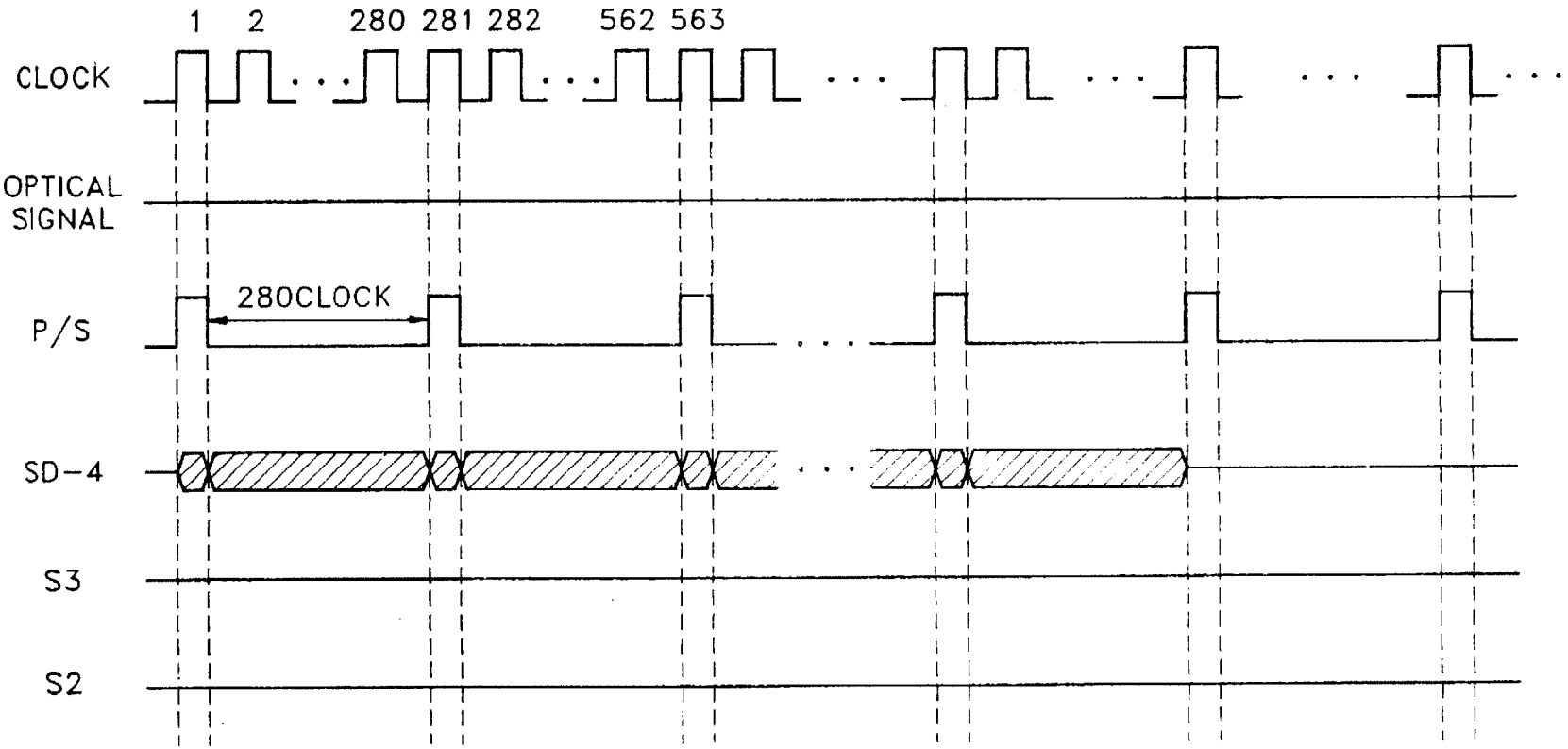
FIG. 10 illustrates signals generated when the contact-points of the board portion short.

FIG. 10 illustrates the waveforms of signals when no vehicle passes through the contact-point boards of the board portion 400 and when there is a short in the board portion 400. When a periodic signal such as SD-4 is generated from the short contact-point board, the signal is regarded as an abnormality.

A method for discriminating a vehicle type according to the present invention will be described, in detail.

TABLE 1

| | classification data | | |
|---|---|---|---|
| class of vehicle | number of axles | tire width (cm) | distance between the left and right tires |
| compact | 2 | 15 or below | 120 or below |
| first | 2 | 28 or below | below 136 |
| second | 2 | above 28 | below 180 |
| third | 2 | above 28 | 180 or above |
| fourth | 3 | — | — |
| fifth | 4 or more | — | — |

As shown in Table 1, a vehicle is discriminated according to the number of axles, tire width, and the distance between the left and right tires.

Figure 11:
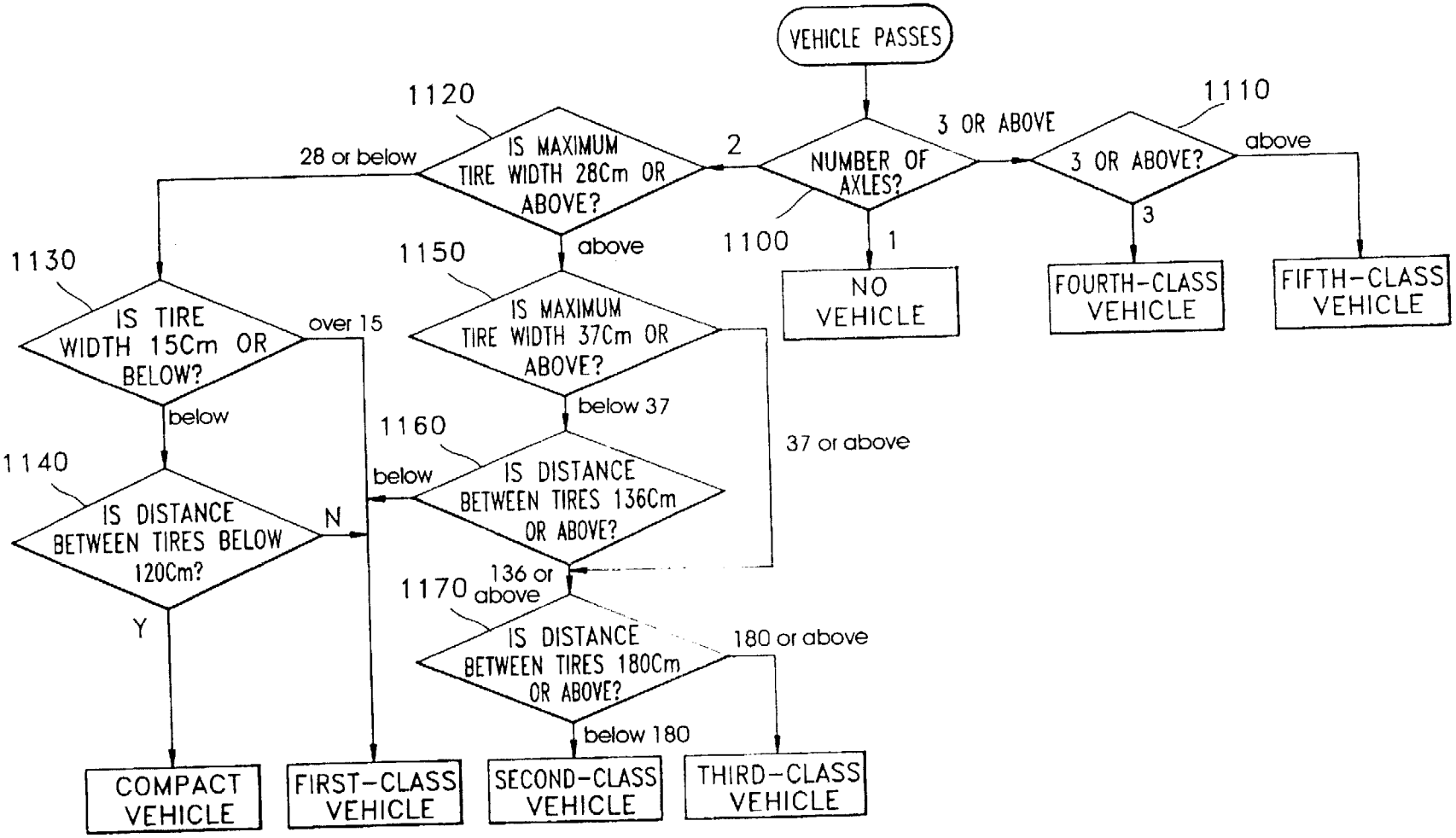
FIG. 11 is a flowchart of a vehicle-type discriminating method according to the present invention.

FIG. 11 is a flowchart of a vehicle-type discriminating method according to the present invention.

In step 1100, the number of axles of a vehicle are counted. Here, if the vehicle has two axles, it is determined that the vehicle is of the first, second or third class. If there are three axles or more, it is determined that the vehicle is of the fourth or the fifth class. If the number of the axles is 3 or more, it is determined whether the number of the axles is 3 in step 1110. If there are 3 axles, the vehicle is discriminated into the fourth class, and if there are 4 or more axles, the vehicle is discriminated into the fifth class.

Further, if the number of the axles is 2, it is determined whether the maximum tire width is 28 cm or above in step 1120. If the maximum tire width is below 28 cm, it is determined whether the maximum tire width is 15 cm or less in step 1130. If the tire width is over 15 cm, the vehicle is discriminated into the first class. If the tire width is less than 15 cm, it is determined whether the distance between the left and right tires is 120 cm or less in step 1140. If the distance between the left and right tires is less than 120 cm, the vehicle is discriminated as a compact vehicle, if the distance between the left and right tires is 120 cm or above, the vehicle is discriminated as a first class vehicle.

If the maximum tire width is 28 cm or over in step 1120, it is determined whether the maximum tire width is 37 cm or over in step 1150. If the maximum tire width is less than 37 cm, it is determined whether the distance between the left and right tires is 136 cm over in step 1160. If the distance between the left and right tires is below 136 cm, the vehicle is discriminated as a first class vehicle.

If the maximum tire width is 37 cm or over in step 1150, and the distance between the left and right tires is 136 cm or over in step 1160, it is determined whether the distance between the left and right tires is 180 cm or over in step 1170. If the distance between the left and right tires is 180 cm or over, the vehicle is discriminated into the third class, and if the distance between the left and right tires is below 180 cm, the vehicle is discriminated into the second class.

If the number of the axles is 1 in step 1110, it is determined that the object is not a vehicle.

Figure 12:
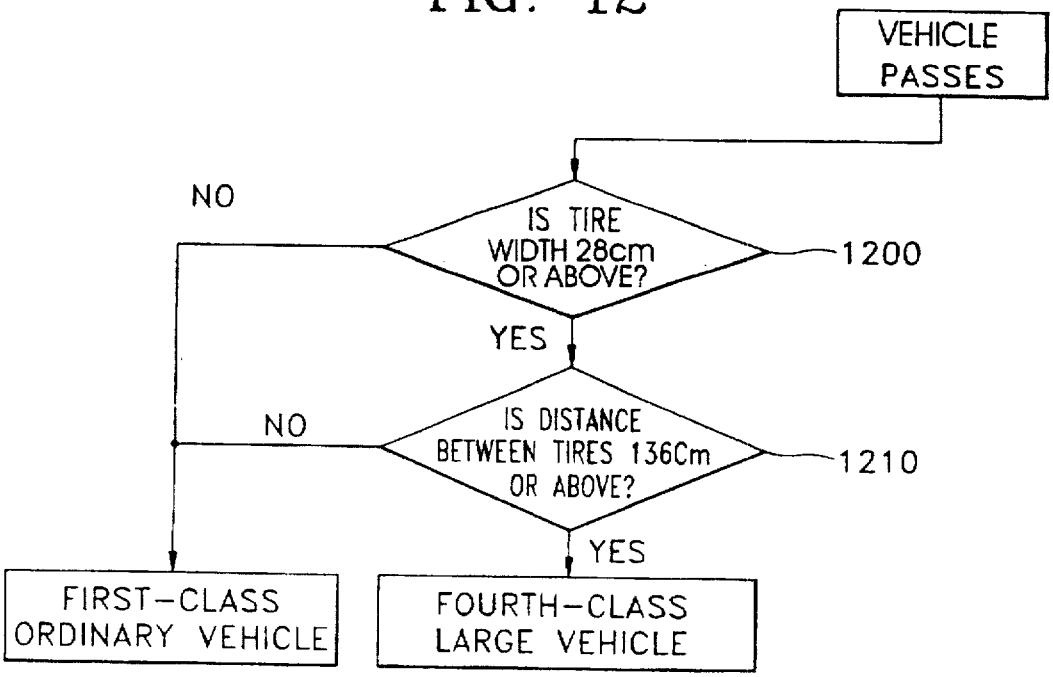
FIG. 12 is a flowchart for the method for discriminating a real 3-axle vehicle from a first-class vehicle misjudged as a 3-axle vehicle.

FIG. 12 is a flowchart for determining whether a vehicle is a 3-axle vehicle, that is, of discriminating a real 3-axle vehicle from a vehicle appended with a first-class ordinary vehicle which may be misjudged as a 3-axle vehicle.

If a 3-axle vehicle passes, it is determined whether the tire width is 28 cm or over in step 1200. If the tire width is less than 28 cm, the vehicle is discriminated into the first class, and if the tire width is 28 cm or over, it is determined whether the distance between tires is 136 cm or over in step 1210. If the distance between tires is less than 136 cm, the vehicle is discriminated into the first class, and if the distance between tires is 136 cm or over, the vehicle is discriminated as a fourth-class large vehicle.

Figure 13:
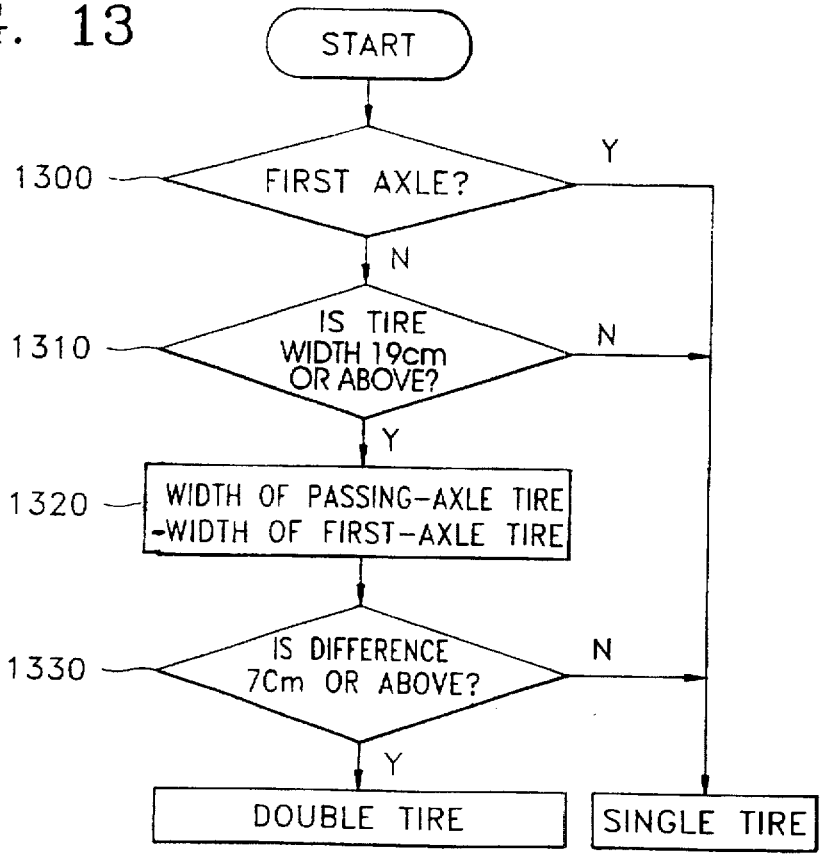
FIG. 13 is a flowchart for the method for discriminating a single tire from a double tire.

FIG. 13 is a flowchart for determining the tire width, that is, discriminating between a single tire from a double tire, according to the present invention.

In step 1300, it is determined whether a tire is of a first axle. If a vehicle has one axle, the tire is discriminated as a single tire.

If the tire is not of the first axle, it is determined whether the tire width is 19 cm or over in step 1310. If the tire width is less than 19 cm, the tire is discriminated as a single tire, and if the tire width is 19 cm or over, the width of the first-axle tire is subtracted from the width of the passing-axle tire, in step 1320. Then, it is determined whether the subtrahend is 7 cm or less in step 1330. If the subtrahend is less than 7 cm, the tire is discriminated as a single tire, and if the subtrahend is 7 cm or more, the tire is discriminated as a double tire.

As described above, in the apparatus and method for discriminating a vehicle type, the tire width of a vehicle, the distance between the left and right tires and the number of axles are processed in real time by outputting a digital signal from a contact-point in which a board portion makes contact with a tire of a passing vehicle. In addition, even if either contact-point boards (a) or (d) for discriminating a vehicle type breaks down, a vehicle can be effectively discriminated.

While this invention has been described in connection with what is presently considered to be the most practical and preferred embodiment, it is to be understood that the invention is not limited to the disclosed embodiments, but, on the contrary, it is intended to cover various modifications and equivalent arrangements included within the spirit and scope of the appended claims.

What is claimed is:

1. A vehicle-type discriminating apparatus comprising:

a board portion for outputting a serial digital signal from a contact-point board in which said board portion makes contact with a tire of a passing vehicle;

a serial-to-parallel converting portion for converting said serial digital signal output from said board portion into a parallel digital signal;

a parallel port interface;

a clearing portion for resetting an uncertain signal output from said board portion;

a digital-to-analog converting portion for converting said digital signal into an analog signal for counting the number of axles of said passing vehicle;

an interrupt portion for determining whether contact-point boards are pressed, and setting a parallel-input-serial-output (P/S) signal at a high level, to wait to receive an input signal;

an optical sensing portion for projecting an optical signal to discriminate between continuously passing vehicles;

a controlling portion for controlling the signals output from said parallel port interface, said clearing portion, said digital-analog portion, said interrupt portion, and said optical sensing portion and for storing the signals in a first memory;

a second memory for storing a predetermined vehicle-type discriminating program; and a central processing portion for discriminating said vehicle by calculating the tire width, the distance between the left and right tires, and the number of the axles of said vehicle, on the basis of said predetermined vehicle-type discriminating program stored in said second memory, according to a signal output from said controlling portion.

2. A vehicle-type discriminating apparatus as claimed in claim 1, wherein said board portion comprises shift registers for outputting a digital signal corresponding to a contact-point board in which a tire of said passing vehicle makes contact with said board portion.

3. A vehicle-type discriminating method comprising the steps of:

(a) counting the number of axles of a vehicle;

(b) discriminating the vehicle into the fourth class, if said number of axles is 3 in said step (a), and discriminating the vehicle into the fifth class, if said number of axles is greater than 3;

(c) determining whether the tire width of said vehicle is a first predetermined length or over, if said number of axles is 2;

(d) determining whether the maximum tire width is a second predetermined or less, if the tire width is less than said first predetermined length in said step (c);

(e) discriminating said vehicle into the first class, if the tire width is over said second predetermined length in said step (d);

(f) determining whether the distance between the left and right tires is less than a third predetermined length, if the tires width is said second predetermined length or less in said step (d);

(g) discriminating said vehicle as a compact vehicle, if the distance between the left and right tires is less than said third predetermined length in said step (f), and discriminating said vehicle into the first class, if the distance between the left and right tires is said third predetermined length or over;

(h) determining whether the tire width is said fourth predetermined length or over, if the tire width is said first predetermined length or over in said step (c);

(I) determining whether the distance between the left and right tires is a fifth predetermined length or over, if the maximum tire width is less than said fourth predetermined length in said step (h);

(j) discriminating said vehicle into the first class, if the distance between the left and right tires is said fifth predetermined length or over in said step (I);

(k) determining whether the distance between the left and right tires is a sixth predetermined length, if the tire width is said fourth predetermined length or over in said step (h), and the distance between the left and right tires is said fifth predetermined length or over;

(l) discriminating said vehicle into the third class if the distance between the left and right tires is said sixth predetermined length or over, and discriminating said vehicle into the second class if the distance between the left and right tires is less than said sixth predetermined length; and (m) determining that said vehicle is not a real vehicle, if the number of said axles is 1 in said step (a).

4. A vehicle-type discriminating method as claimed in claim 3, said first predetermined length being 28 cm.

5. A vehicle-type discriminating method as claimed in claim 3, said second predetermined length being 15 cm.

6. A vehicle-type discriminating method as claimed in claim 3, said third predetermined length being 120 cm.

7. A vehicle-type discriminating method as claimed in claim 3, said fourth predetermined length being 37 cm.

8. A vehicle-type discriminating method as claimed in claim 3, said fifth predetermined length being 136 cm.

9. A vehicle-type discriminating method as claimed in claim 3, said sixth predetermined length being 180 cm.

10. A vehicle-type discriminating method as claimed in claim 3, wherein to discriminate a real 3-axle vehicle from a vehicle appended with a first-class ordinary vehicle which may be misjudged as a 3-axle vehicle, said step (a) comprises the steps of:

(a') determining whether the tire width of a passing vehicle is said first predetermined length or over;

(b') discriminating said vehicle into the first class, if said tire width is less than said first predetermined length in said step (a');

(c') determining whether the distance between the left and right tires is said fifth predetermined length or over, if said tire width is said first predetermined length or over; and (d') discriminating said vehicle into the first class, if said distance between the left and right tires is less than said fifth predetermined length in said step (c'), and discriminating said vehicle as a 4-axle vehicle, if said distance between the left and right tires is said fifth predetermined length or over.

11. A vehicle-type discriminating method as claimed in claim 10, said first predetermined length being 28 cm.

12. A vehicle-type discriminating method as claimed in claim 10, said second predetermined length being 15 cm.

13. A vehicle-type discriminating method as claimed in claim 10, said third predetermined length being 120 cm.

14. A vehicle-type discriminating method as claimed in claim 10, said fourth predetermined length being 37 cm.

15. A vehicle-type discriminating method as claimed in claim 10, said fifth predetermined length being 136 cm.

16. A vehicle-type discriminating method as claimed in claim 10, said sixth predetermined length being 180 cm.

17. A method for discriminating a single tire from a double tire of a passing vehicle comprising the steps of:

(a") determining whether a tire is of a first axle of the vehicle;

(b") discriminating said tire as a single tire if said tire is of the first axle in said step (a");

(c") determining whether the width of said tire is a first predetermined length or over;

(d") discriminating said tire as a single tire if the width of said tire is less than said first predetermined length in said step (c");

(e") subtracting the width of said first-axle tire from the width of a passing-axle tire if the width of said tire is said first predetermined length or over in said step (c");

(f") determining whether the subtrahend of said step (e") is a second predetermined length or over; and (g") discriminating said tire as a single tire if the subtrahend is less than said second predetermined length in said step (f"), and discriminating said tire as a double tire if the result is said second predetermined length or over.

18. A method for discriminating a single tire from a double tire of a passing vehicle as claimed in claim 17, said first predetermined length being 19 cm.

19. A method for discriminating a single tire from a double tire of a passing vehicle as claimed in claim 17, said second predetermined length being 7 cm.

* * * * *